United States Patent [19]

Takahashi et al.

[11] Patent Number: 4,756,233

[45] Date of Patent: Jul. 12, 1988

[54] AIR FILTER SYSTEM FOR A VACUUM ACTUATOR

[75] Inventors: Yoshikazu Takahashi; Toshio Nishiyama, both of Kiryu, Japan

[73] Assignee: Mitsuba Electric Mfg. Co., Ltd., Japan

[21] Appl. No.: 87,913

[22] Filed: Aug. 21, 1987

[51] Int. Cl.[4] ..... F15B 11/08

[52] U.S. Cl. ..... 91/449; 55/417; 55/484; 55/487; 91/454; 91/459; 137/550; 251/118

[58] Field of Search ..... 91/418, 443, 449, 454, 91/457, 459; 180/175, 176, 177; 137/315, 454.6, 15, 550; 251/367, 129.15, 118; 55/487, 484, 417, 486

[56] References Cited

U.S. PATENT DOCUMENTS

| | | | |
|---|---|---|---|
| 3,365,864 | 1/1968 | Iizima | 55/487 X |
| 3,692,043 | 9/1972 | Waskowsky | 137/550 X |
| 4,141,703 | 2/1979 | Mulchi | 55/487 X |
| 4,346,775 | 8/1982 | Treadwell | 180/175 |
| 4,431,077 | 2/1984 | Burney | 180/176 |
| 4,543,983 | 10/1985 | Pauliukonis | 137/550 X |

*Primary Examiner*—Edward K. Look
*Attorney, Agent, or Firm*—Marshall & Melhorn

[57] ABSTRACT

Disclosed is an air filter unit for a pressure actuator such as a vacuum actuator for a speed control of an automobile comprising a solenoid valve unit including a plurality of solenoid valves and a diaphragm unit including a diaphragm defining a pressure chamber, air pressure within the pressure chamber being adjusted by selective activation of the solenoid valves which communicate the pressure chamber with pressure sources of different pressure levels. A filter element holder defining a pair of receptacles for receiving filter elements therein is attached to the solenoid valve unit so as to intercept air flow from an external air source into the vacuum chamber by way of the solenoid valves. The filter element for a vent valve which is frequently used is finer in structure than that for a safety valve which is less frequently used and is required to be capable of rapid introduction of air into the vacuum chamber. Preferably, the end wall of the receptacle, having a hole which communicates the pressure chamber with the external relatively positive air source, is provided with a step defining a clover shaped space between the filter element and the bottom surface of the receptacle for increasing the surface area of the filter element presented to the air flow for reducing the flow resistance of the filter element and increasing the durability of the filter element through prevention of local clogging of the filter element.

6 Claims, 4 Drawing Sheets

AIR FILTER SYSTEM FOR A VACUUM ACTUATOR

TECHNICAL FIELD

The present invention relates to a pressure actuator which derives power from a difference of pressure between two pressure sources such as an engine intake system and the atmosphere and in particular to an air filter system for a vacuum actuator for vehicle speed control which is economical and reliable. Typically, one of the pressure sources is the atmosphere but the other pressure source may be either a negative pressure source such as an engine intake system or a positive pressure source derived from an air pump or the like (for instance in the case of a supercharged engine from which negative pressure is not always available).

BACKGROUND OF THE INVENTION

From the past, various speed control devices for maintaining vehicle speed at fixed levels have been known. According to such a speed control device which is sometimes called as a cruise control device, the driver is not required to keep stepping on the accelerator pedal to keep the automobile cruising at a constant speed and he is free from the need for adjusting the depression of the accelerator pedal in order to maintain a constant speed irrespective of the inclination and other conditions of the road.

Vacuum actuators which derive power from negative pressure of the engine intake system are commonly used as actuators for vehicle speed control. A conventional typical vacuum actuator comprises a diaphragm which defines a negative pressure chamber in cooperation with the casing of the actuator and a plurality of solenoid valves which selectively communicate the negative pressure chamber with the intake system of the engine or the atmosphere as required, and the resulting displacement of the diaphragm is transmitted to the accelerator pedal by way of a control cable. The solenoid valves are controlled by a control device incorporating a micro processor, and the output of a speed sensor is supplied to the control device. Thus, using the vehicle speed as a controlled variable and the accelerator pedal depression as a manipulated variable, the control device controls the accelerator pedal depression by way of the solenoid valves and maintains the vehicle speed at a constant level by a feedback control.

Specifically, negative pressure from the engine intake system is supplied to the negative pressure chamber by way of a negative pressure valve when the accelerator pedal depression is required to be increased, and the atmospheric pressure is introduced into the negative pressure chamber by way of a vent valve when the accelerator pedal depression is required to be reduced. Additionally, when the accelerator pedal is required to be quickly released, for instance when the vehicle brake is activate, a safety valve is activated and quickly communicates the negative pressure chamber with the atmosphere. Thus, in order to assure a high level of reliability, the vent valve and the safety valve are used in parallel in a redundant manner.

While the negative pressure source only draws air from the actuator, the atmospheric air supplied to the actuator through the vent valve and the safety valve must be actually introduced into the valves and eventually to the engine intake system. Therefore, in order to assure proper functioning of the solenoid valves, the atmospheric air must be filtered with an air filter unit which is typically internally equipped in the actuator. Since the air is more or less continually introduced into the actuator, the air filter unit must be capable of functioning properly for a long time period without replacing filter elements. Clogging of the air filter elements will cause a failure of the actuator.

Japanese Patent Laid-Open Publication No. 62-96144 (based on U.S. patent application Ser. No. 783,039 filed on Sept. 30, 1985 now abandoned) discloses a vacuum actuator of this type. This actuator is provided with a vent valve and a safety valve, but an air filter device having a single filter element which is common to the vent valve and the safety valve selectively communicates a vacuum chamber defined by a diaphragm with the atmosphere. However, according to this prior art, the air passage within the filter element appears to be restricted and local clogging of the filter element appears to be inevitable over an extended service period.

BRIEF SUMMARY OF THE PRESENT INVENTION

In view of such and other problems of the prior art, a primary object of the present invention is to provide an air filter system for a vacuum actuator which is capable of effectively removing foreign matters from the air introduced into the actuator over a long time period.

Another object of the present invention is to provide an air filter system for a vacuum actuator which is free from clogging over a long period by efficient utilization of a filter element.

Yet another object of the present invention is to provide an air filter system for a vacuum actuator which is effective in removing foreign matters and is yet capable of rapid venting action as required.

Yet another object of the present invention is to provide an air filter system for a vacuum actuator which offers relatively small flow resistance to the incoming air flow.

According to the present invention, these and other objects of the present invention can be accomplished by providing an air filter unit for a pressure actuator comprising a solenoid valve unit including a plurality of solenoid valves and a diaphragm unit including a diaphragm defining a pressure chamber, air pressure within the pressure chamber being adjusted by selective activation of the solenoid valves which communicate the pressure chamber with pressure sources of different pressure levels, comprising: a filter element holder defining a pair of receptacles for receiving filter elements therein, the filter elements being so disposed as to intercept air flow from an external air source into the vacuum chamber by way of corresponding ones of the solenoid valves; the first filter element received in one of the receptacles being finer in structure than the second filter element received in the other receptacle.

Thus, the air filter system is effective in removing foreign matters and is yet capable of rapid venting action as required. According to a preferred embodiment of the present invention, the first filter element consists of a combination of a paper filter element and a urethane foam filter element while the second filter element consists solely of a urethane foam filter element.

According to a certain aspect of the present invention, the receptacles are arranged in the filter element holder in a mutually parallel relationship, one end of each of the receptacles being communicated with a port of corresponding one of the solenoid valves while the other end of the receptacle is communicated with a common air inlet provided in a casing of the actuator; the one end of at least the receptacle which receives the first filter element being provided with a bottom wall having a hole and a step for contacting the paper filter element so as to define a depression communicated with the hole and extending in a radial direction.

Thus, through effective utilization of the filter element, the air filter system offers relatively small flow resistance to the incoming air flow and is free from clogging over a long period.

According to another aspect of the present invention, the paper filter element and the urethane foam filter element of the first filter element have different colors while at least a part of the filter element holder defining the receptacle receiving the first filter element is made of at least semitransparent material and the air filter holder is provided with a part which is complementary in shape to a corresponding part of the casing of the actuator for preventing the air filter holder to be fitted into the casing with improper orientation. This is advantageous for preventing omissions and errors in assembling the actuator.

DETAILED DESCRIPTION OF THE PREFERRED EMBODIMENT

Now the present invention is described in the following with reference to the appended drawings.

Figure 1:
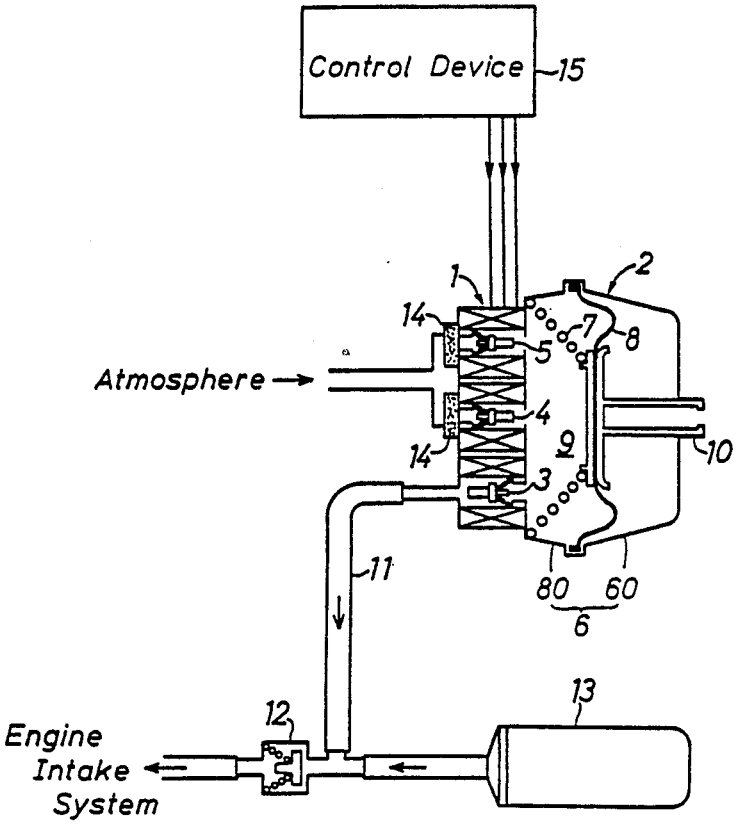
FIG. 1 is a schematic view illustrating the overall structure and the action of the cruise control device to which the vacuum actuator of the present invention is applied.

FIG. 1 shows a preferred embodiment of the vacuum actuator according to the present invention, and this vacuum actuator comprises a solenoid valve unit 1 and a diaphragm unit 2. The overall housing 6 of this vacuum actuator comprises a casing 80 which is made of synthetic resin material and accommodates the solenoid valve unit 1 and another casing 60 which is made of sheet metal and accommodates diaphragm unit 2. The solenoid valve unit 1 comprises a vacuum valve 3, a safety valve 4 and a vent valve 5.

Figure 6:
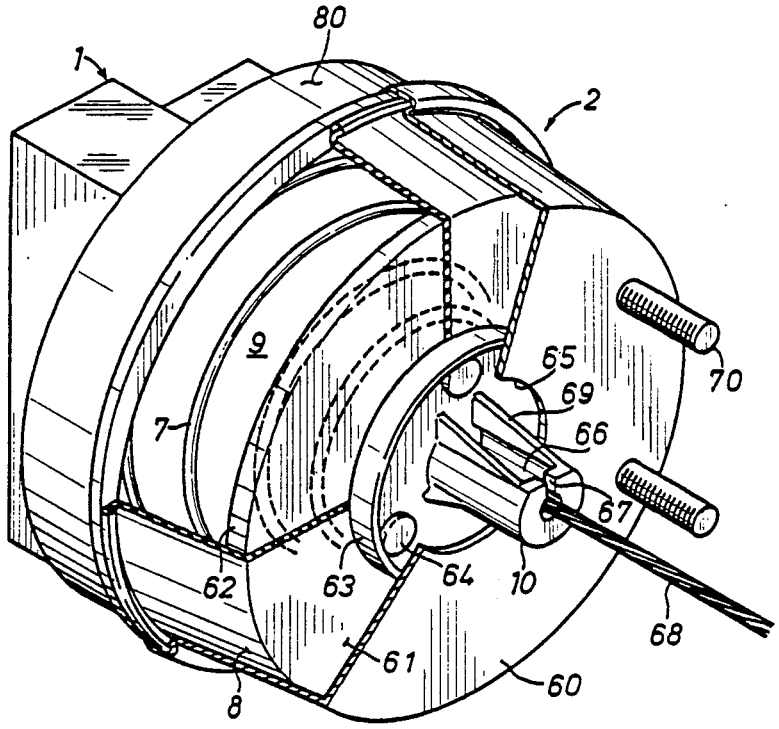
FIG. 6 is a partly broken-away perspective view of the vacuum actuator.

As best shown in FIG. 6, a diaphragm 8 which is biased by a conical coil spring 7 is interposed between the two parts of the housing 6 and defines a vacuum chamber 9 in cooperation with the casing 80 of the solenoid valve unit 1. A wire holder 10 is attached to a central part of the diaphragm 8 so as to project out of the casing 60 of the diaphragm unit 2. Thus, dependent upon the magnitude of the negative pressure in the negative pressure chamber 9, the wire holder 10 is axially displaced and actuates a accelerator pedal (not shown in the drawings) by way of a control cable as described in greater detail hereinafter.

A first port of the vacuum valve 3 is connected to an engine intake system (not shown in the drawings) by way of a conduit 11 and a check valve 12 while a second port of the vacuum valve 3 is communicated with the vacuum chamber 9 within the casing 80 as described hereinafter. The conduit 11 is also connected to an accumulator 13 for storing vacuum or negative pressure therein Thus, by opening this vacuum valve 3, the negative pressure in the negative pressure chamber 9 is increased and the diaphragm 8 is pulled inwardly against the spring force of the conical coil spring 7 thereby actuating the accelerator pedal in the direction to increase the vehicle speed.

A first port of the vent valve 4 is connected to the atmosphere by way of an air filter unit 14 while a second port of the vent valve 4 is likewise communicated with the vacuum chamber 9 within the casing 80. Therefore, by opening the vent valve 4, the negative pressure in the negative pressure chamber 9 is reduced by the introduction of atmospheric air into the negative pressure chamber 9 and the diaphragm 8 is pushed outwardly by the conical coil spring 7 thereby actuating the accelerator pedal in the direction to reduce the vehicle speed.

A first port of the safety valve 5 is communicated with the atmosphere by way of the air filter unit 14 in the same way as the vent valve 4 while a second port of the safety valve 5 is likewise communicated with the vacuum chamber 9 within the casing 80. By opening the safety valve 5, the negative pressure chamber 9 is rapidly communicated with the atmosphere. This safety valve 5 is opened when the action of the cruise control is to be stopped either as a voluntary action of the driver or as an automatic action when the control system has detected a certain condition.

These solenoid valves 3 to 5 are controlled by signals from the control circuit 15.

Figure 2:
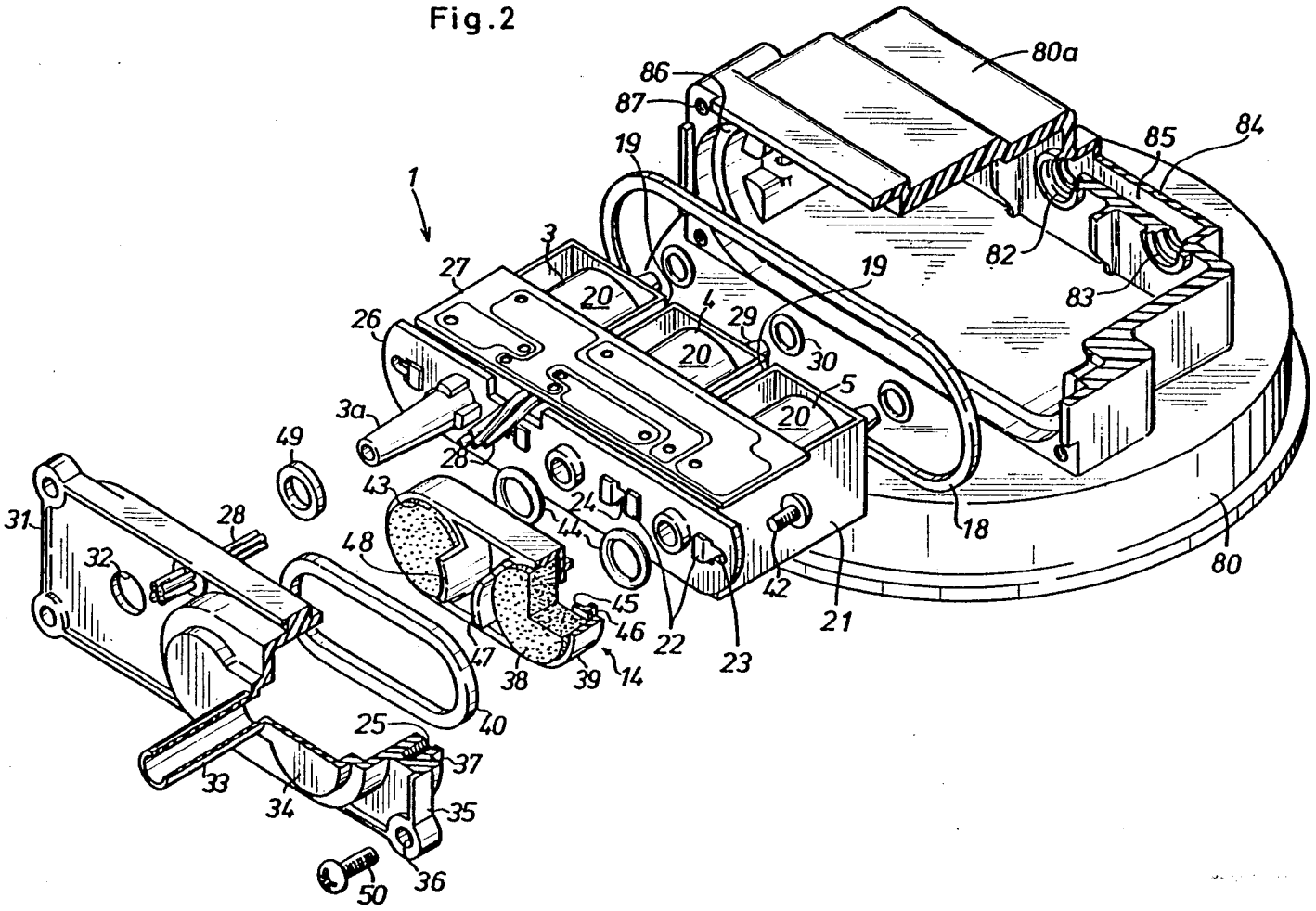
FIG. 2 is an exploded perspective view of the vacuum actuator according to the present invention.

FIG. 2 shows the solenoid valve unit 1 of the above described actuator unit in greater detail. The casing 80 of the solenoid valve unit 1 is generally dish-shaped and is integrally provided with an extension **80*a* defining an open-ended box. The inner circumference of the open end of the extension 80*a* is provided with a step 86 for supporting a sealing gasket 18 as described hereinafter. Further, the four corners of the open end of the extension 80*a* are each provided with a threaded hole 87**.

The closed end of the extension **80*a* opposite to the open end or the bottom of the extension 80*a* is provided with three holes 82 and 83 for receiving the second ports 29 of the valves 3 to 5 by way of O-rings 30 in an air-tight manner. (The corresponding hole for the vacuum valve 3 is hidden in FIG. 2.) The hole for the vacuum valve 3 is individually communicated with the vacuum chamber 9 while the holes 82 and 83 are communicated with the vacuum chamber 9 by way of a common passage 85 defined by a bulge 84 projecting from the bottom wall 80*b* of the extension 80*a***.

Each of the valves 3 to 5 comprises a solenoid 20 and a yoke 21 defining a magnetic circuit outside the solenoid 20 in addition to a valve member, a valve seat and a return spring which are shown only in FIG. 1 in a simplified manner. The yokes 21 are generally C-shaped shaped and their open ends are provided with tongues 22 which are passed through corresponding holes 23 and 24 of a plate 26 and crimped thereto. The plate 26 also serves as a part of the magnetic circuits of the three solenoid valves 3 to 5. As can be seen from FIG. 2, the holes 23 are elongated in shape and additionally receive a pair of small screws 42 which secure the plate 26 to an end cover 31 by being threaded into corresponding threaded holes 25 provided in the end cover 31. The end cover 31 is made of the same material as the casing 80 and defines an enclosed space for accommodating the solenoid valve unit 1 in cooperation with the extension 80*a*. The holes 24 are also elongated in shape and each receive a pair of tongues 22 belonging to two adjoining yokes 21. These holes 23 and 24 are thus shared either by two tongues or by a tongue and a screw. This not only reduces the work required for punching these holes as compared with the case of providing individual holes for different tongues and screws but also saves space by eliminating the problems involved in forming closely adjoining holes.

The coil wires of these solenoid valves 3 to 5 are connected to a circuit board 27 attached to a broader surface of the solenoid valve unit 1 and are appropriately wired to lead wires 28 which extend to the outside. The other or the first ports 3*a* and 41 of the solenoid valves 3 to 5 project through the plate 26. The first port 3*a* of the vacuum valve 3 is defined by an axially elongated member and is passed through a hole 32 provided in the end cover 31 with an annular seal member 49 made of polymer material fitted over the port member to assure the sealing requirements The end cover 31 is further provided with a bulge 34 which accommodates an air filter unit 14. The air filter unit 14 is provided with an air filter holder 39 which is elliptic in shape and accommodates a pair of air filter elements 38. The side of the air filter holder 39 facing the end cover 31 is generally exposed and its outer circumferential edge directed towards the end cover 31 is pressed against the inner surface of the bulge 34 by way of a rubber gasket 40. Vertical walls 47 and 48 are provided in middle parts of the air filter holder 39 facing the end cover 31 so as to control the air flow from an air inlet tube 33 provided integrally with the bulge 34 to the two air filter elements 38. The other side of the air filter holder 39 is provided with a pair of holes 45 which are concentric to the filter elements 38 and are surrounded by concentric annular projections 46 projecting towards the valves 3 to 5. These holes 45 are fitted over the first ports 41 of the vent valve 4 and the safety valve 5 and O-rings 44 fitted inside the annular projections 46 are pressed against the plate 26 around the ports 41 and meet the sealing requirements.

Thus, when the small screws 42 are passed through the holes 23 in the plate 26 and threaded into the threaded holes 25 of the end plate 31, the air filter unit 14 is interposed between the plate 26 and the end cover 31.

Further, when the solenoid valve unit 1 including the end cover 31, the air filter unit 14 and the solenoid valves 3 to 5 is inserted into the extension 80*a* of the casing 80, the valve assembly 1 is guided by the ribs 92 and 93 and the pointed corners of the solenoid valve unit 1 as well as the rugged portions of the printed circuit board 27 are prevented from contacting the inner surface of the extension 80*a*. Since the ribs 92 and 93 contact predetermined definite surface areas the solenoid valve unit 1 which are preselected to be smooth, the insertion of the solenoid valve unit 1 into the extension 80*a* can be accomplished in an extremely smooth manner and there is no possibility of scraping off chips from the inner surface of the extension 80*a*. When the solenoid valve unit 1 is completely fitted into the extension, small screws 50 are passed through the holes 36 provided on the four corners of the end cover 31 and threaded into the threaded holes 87 provided in the open end of the extension 80*a*.

As the solenoid valve unit 1 is completely fitted into the extension 80*a*, the ribs 94 provided in the bottom wall 80*b* of the extension are forced into the gaps 19 between the neighboring yokes 21 of the solenoid valve unit 1 and the yokes 21 are thus precisely positioned and held securely at their predetermined positions. Therefore, even when the yokes 21 are not sufficiently rigid by themselves, they are held rigidly and securely once they are assembled into the extension 80*a*. Thus, the thickness of the yokes 21 can be minimized and the weight and the space requirements of the solenoid valve unit 1 can be reduced.

When the solenoid valve unit 1 is completely fitted into the extension 80*a*, small screws 50 are passed through the holes 36 provided on the four corners of the end cover 31 and threaded into the threaded holes 87 provided in the open end of the extension 80*a*.

Figure 3:
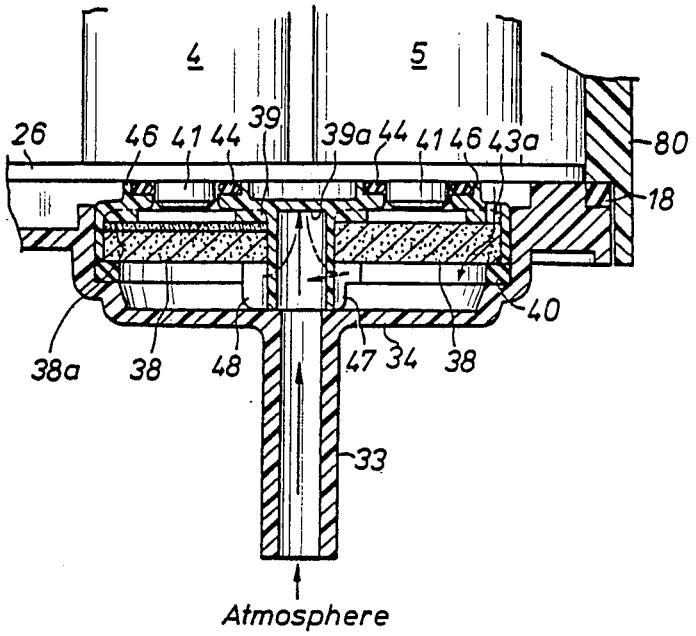
FIG. 3 is a sectional view showing the air filter unit in greater detail.
Figure 4:
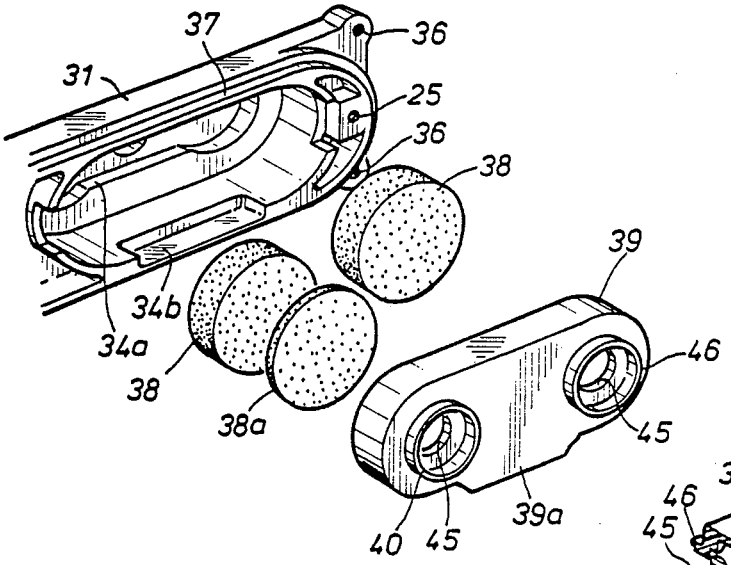
FIG. 4 is an exploded perspective view of the air filter unit showing how it is fitted into an internal depressi,on of an end cover of the casing of the actuator.
Figure 5:
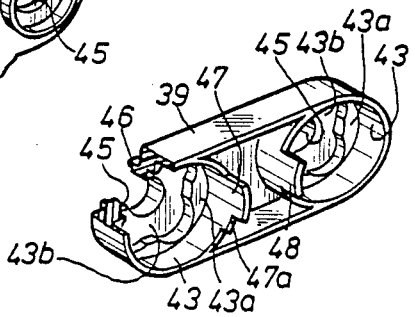
FIG. 5 is a partly cut-away perspective view of the filter element holder.

FIGS. 3 through 5 show the air filter unit in greater detail.

As best shown in FIG. 5, the filter element holder 39 defines a pair of cylindrical receptacles 43 for accommodating the filter elements 38. The bottom surface of each of these receptacles 38 is provided with a step 43*a* defining a clover shaped depression 43*b* which is located around the hole 45 and extends radially from the hole 45 to the outer wall of the receptacle 43. The filter elements 38 are made of foam material such as urethane foam, and an additional filter element 38*a* made of filter paper is interposed between the bottom of the receptacle 38 having the hole 45 and the filter element 38 made of urethane foam for the vent valve 4. On the other hand, no such additional filter element made of paper is placed in the receptacle 38 for the safety valve 5.

This arrangement of the filter elements 38 and 38*a* is advantageous because the paper filter element 38*a* having a finer structure provides a high filtering capability for the vent valve 4 which is active throughout the time the cruise control device is operating while the air passage for the safety valve 5, which is activated only when the cruise control is to be stopped and is therefore relatively rarely operated, is obstructed only by the filter element 38 made of urethane foam which has a coarse structure and is therefore highly permeable so as to assure rapid introduction of air into the vacuum chamber 9 when required. Also, the clover shaped depression 43*b* is advantageous because the filter element 38 or 38*b*, as the case may be, presents substantially whole major surface thereof to the hole 45, and assures uniform distribution of air flow within the filter element so as to effectively utilize the whole filter elements 38 and 38*a* and eliminate the possibility of the occurrence of local clogging of the filter element 38 or 38*a*. This is particularly significant for the paper filter element 38*a*.

Further, since the filter element holder 39 is made of substantially transparent or semi-transparent plastic material and the paper filter element 38*a* is tinted to a conspicuous color such as red while the color of the filter elements 38 made of urethane foam is gray, it is easy to detect possible omission of the paper filter element 38 during the inspection process which is typically included in the assembly process of the actuator. Also, a flange 39*a* integrally provided to a side end of the filter element holder 39 is adapted to be fitted into a notch 34*b* defined in the end cover 31 and this assures the prevention of inadvertent inversion of the filter element holder 39 when fitting it into the end cover 31 during the process of assembling the actuator.

As best shown in FIG. 3, a small hole 43*a* extends from the external bottom surface of the filter element holder 39 facing the solenoid valve unit 1 externally of the annular projection 46 to the interior of the receptacle 43 receiving the filter element 38. This small hole 43*a* provides a passage for the breathing air into and out of the casing 80 resulting from the change in temperature. Since this breathing air passage is intercepted by the filter element 38, introduction of foreign matters into the casing 80 is prevented and the reliability of the action of the actuator is thus improved.

As can be seen from FIGS. 3 through 5 taken together, the vertical walls 47 and 48 project into a depression 34*a* provided in the end cover 31 and the air introduced from the air inlet tube 33 is guided to a space 39*a* defined between the two vertical walls 47 and 48 instead of being diverted to the filter elements 38 directly. As a result, relatively heavy foreign matters which are introduced from the air inlet tube 33 tend to settle in the space 39*a* and are prevented from reaching the filter elements 38 and thereby clogging the filter elements 38 rapidly. Preferably, the actuator is mounted to an external member in such an orientation that the air inlet tube 33 depend vertically from the casing 80 of the actuator or, in other words, as shown in FIG. 3. Therefore, lighter foreign matters will be trapped by the filter elements 38 and 38*a* while heavier foreign matters will be separated from the air flow in the space 39*a* and drop through the air inlet tube 33 out of the actuator In this conjunction, it should be noted that the vertical wall 47 for the safety valve 5 is provided with a notch 47*a* for permitting a relatively free flow of air because the safety valve 5 is relatively rarely used and required to be capable of rapid introduction of air, and the clogging of the air filter 38 is therefore a relatively minor problem.

FIG. 6 shows the diaphragm unit 2 in detail. The casing 60 which is made of sheet metal such as aluminum plate press-formed into a frusto-conical shape and is crimped over the casing 80 of the solenoid valve unit 1 interposing the circumferential fringe of the diaphragm therebetween. The casing 60 is integrally provided with a plurality of stud bolts 70 for mounting the vacuum actuator to an external member. The diaphragm 8 is cup-shaped so as to be substantially complementary to the inner surface of the diaphragm unit casing 60. A flat middle portion 61 of this diaphragm 8 is interposed between a pair of discs 62 and 63 which are securely joined together by rivets 64. The inner disc 62 located inside the vacuum chamber 9 is substantially conformal to the flat middle portion of the diaphragm 8 while the other or the outer disc 63 is slightly greater than a central opening 65 provided in the central part of the diaphragm casing 60. A conical coil spring 7 is interposed between the inner disc 62 and the solenoid valve unit casing 80 and biases the diaphragm 8 in the direction to increase the volume of the vacuum chamber 9. The outer surface of the outer disc 63 is provided with a wire holder 10 consisting of a hollow projection which projects out of the central opening 65 of the diaphragm casing 60. This wire holder 10 is provided with a side slit 66 extending along the whole length thereof, a pair of triangular reinforcement ribs 69 extending between the edges of the slide slit 66 and the outer surface of the outer disc 63, and an inwardly directed flange 67 provided in the free end of the projection and defining a small opening 67*a* in its center. The side slit 66 extends into this small opening 67*a*. Thus, by passing an end of a control cable 68 provided with a knot consisting of a block attached to the free end thereof into the opening 67*a* by way of the side slit 66, the control cable 68 can be securely connected to the projection 10. The other end of the control cable 68 is connected to an accelerator pedal which is not shown in the drawings.

Thus, according to the present embodiment, the air introduced into the vacuum chamber 9 by way of the vent valve 4 is finely filtered with a combination of the two filter elements 38 and 38*a* and, thus, although the vent valve 4 is continually used, foreign matters are effectively prevented from entering the actuator. On the other hand, since the filter element 38 for the safety valve 5 consists solely of urethane foam and therefore permits a relatively unobstructed flow of air, the function of the safety valve 5 to rapidly introduce air into the vacuum chamber 9 can be assured. This coarser filtering of the filter element 38 for the safety valve 5 is permissible because the safety valve 5 is relatively infrequently operated and, thus, the cumulative amount of air flow passing through the safety valve 5 is much less than that of the vent valve 4.

Furthermore, since the filter elements 38 and 38*a* present relatively large surface areas for the air flowing into the holes 45 due to the presence of the clover shaped depression 43*b*, foreign matters contained in the air flow are trapped evenly by the whole regions of the filter elements 38 and 38*a*, and the durability of these filter elements 38 and 38*a* is therefore substantially improved. Additionally, the air resistance caused by the filter elements 38 and 38*a* against the air flow is also reduced because of their large surface areas presented to the air flow.

Although the present invention has been shown and described with reference to the preferred embodiment thereof, it should not be considered as limited thereby. Various possible modifications and alterations could be conceived of by one skilled in the art to any particular embodiment, without departing from the scope of the invention.

What we claim is:

1. An air filter unit for a pressure actuator comprising a solenoid valve unit including a plurality of solenoid valves and a diaphragm unit including a diaphragm defining a pressure chamber, air pressure within the pressure chamber being adjusted by selective activation of the solenoid valves which communicate the pressure chamber with pressure sources of different pressure levels, comprising:

a filter element holder defining a pair of receptacles for receiving filter elements therein, the filter elements being so disposed as to intercept air flow from an external air source into the pressure chamber by way of corresponding ones of the solenoid valves;

the first filter element received in one of the receptacles being finer in structure than the second filter element received in the other receptacle.

2. An air filter unit for a pressure actuator as defined in claim 1, wherein the first filter element consists of a combination of a paper filter element and a urethane foam filter element while the second filter element consists solely of a urethane foam filter element.

3. An air filter unit for a pressure actuator as defined in claim 2, wherein the receptacles are arranged in the filter element holder in a mutually parallel relationship, one end of each of the receptacles being communicated with a port of corresponding one of the solenoid valves while the other end of the receptacle is communicated with a common air inlet provided in a casing of the actuator; the one end of at least the receptacle which receives the first filter element being provided with a bottom wall having a hole and a step for contacting the paper filter element so as to define a depression communicated with the hole and extending in a radial direction.

4. An air filter unit for a pressure actuator as defined in claim 2, wherein the paper filter element and the urethane foam filter element of the first filter element have different colors and at least a part of the filter element holder defining the receptacle receiving the first filter element is made of at least semi-transparent material.

5. An air filter unit for a pressure actuator as defined in claim 4, wherein the filter element holder is provided with a part which is complementary in shape to a corresponding part of a casing of the actuator for preventing the filter element holder to be fitted into the casing with improper orientation.

6. An air filter unit for a pressure actuator comprising a solenoid valve unit including a plurality of solenoid valves and a diaphragm unit including a diaphragm defining a pressure chamber, air pressure within the pressure chamber being adjusted by selective activation of the solenoid valves which communicate the pressure chamber with pressure sources of different pressure levels, comprising:

a filter element holder defining a cup-shaped receptacle for receiving a filter element therein in such a manner that the filter element is so disposed as to intercept air flow from a relatively positive pressure source into the pressure chamber by way of the corresponding solenoid valve, a bottom wall of the cup shaped receptacle being provided with a hole for communicating the pressure chamber with the positive pressure source;

an inner surface of the bottom wall being provided with a step which defines a space, between the filter element and an inner surface of the bottom wall, extending radially from the hole with the step spacing the filter element away from the bottom wall of the receptacle.

* * * * *